United States Patent [19]

Jimenez et al.

[11] Patent Number: 4,490,930

[45] Date of Patent: Jan. 1, 1985

[54] FLEXIBLE SUPPORT FOR AN IRONING PRESS HINGE

[75] Inventors: Antonio Jimenez, Meyrin; Olindo Baruffa, Thonex, both of Switzerland

[73] Assignee: Mefina S.A., Fribourg, Switzerland

[21] Appl. No.: 517,231

[22] Filed: Jul. 25, 1983

[30] Foreign Application Priority Data

Aug. 16, 1982 [CH] Switzerland ..... 4887/82

[51] Int. Cl.[3] ..... D06F 71/02

[52] U.S. Cl. ..... 38/32; 16/281; 16/313

[58] Field of Search ..... 38/32, 33, 34, 35, 36, 38/27; 100/228; 16/275, 313, 50, 281, 284

[56] References Cited

U.S. PATENT DOCUMENTS

| | | | |
|---|---|---|---|
| 1,967,085 | 7/1934 | Emeory | 38/32 X |
| 4,300,296 | 11/1981 | Hochstrasser et al. | 38/27 |
| 4,406,034 | 9/1983 | Lindeman | 16/313 |

FOREIGN PATENT DOCUMENTS 508087 7/1971 Switzerland .

*Primary Examiner*—Henry S. Jaudon
*Assistant Examiner*—Andrew M. Falik
*Attorney, Agent, or Firm*—Emory L. Groff, Jr.

[57] ABSTRACT

The frame of an ironing press has flexible abutments made of steel against which a support for roller tracks rests in order to assure a stable position for a lever arm of the press when the press is in an open or closed position. The flexibility of the abutments of the frame make it possible to maintain stable positions of the lever arm during the ironing of fabrics of usual thickness or fabrics of greater than usual thickness.

7 Claims, 5 Drawing Figures

FIG. 1
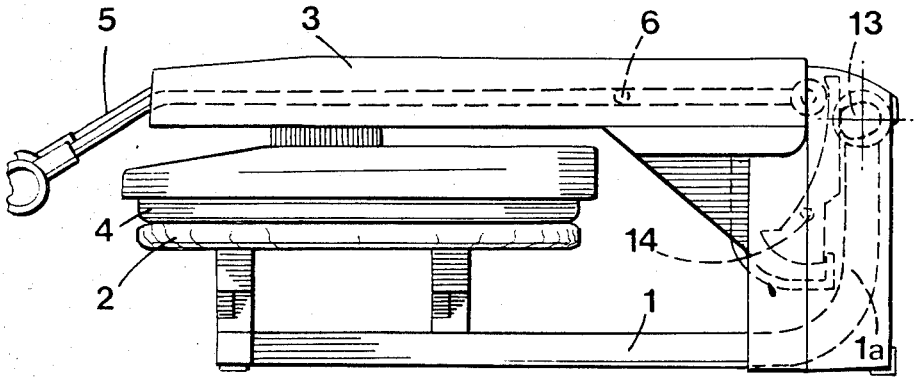
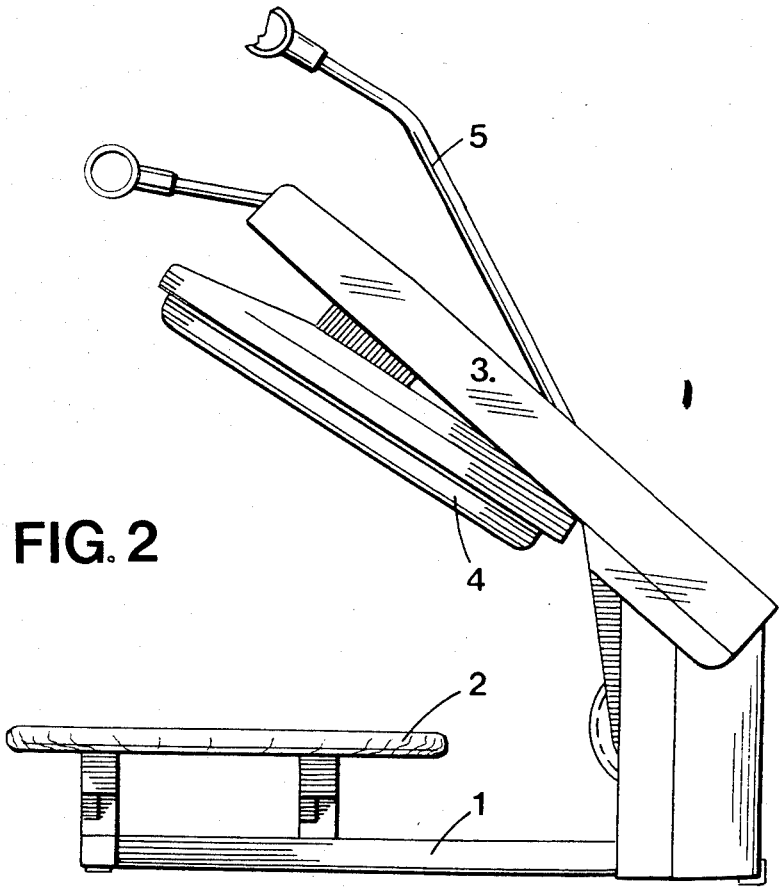
FIG. 2

FLEXIBLE SUPPORT FOR AN IRONING PRESS HINGE

An electric ironing press is known by Swiss patent No. 508,087 in which the opening and closing of the press is assured by a lever hinged on the support arm of a heating plate, at a point distant from the hinge pin of the arm on the support frame of the ironing board, this lever extending beyond its hinge point with the arm and having at its free end rollers held by a spring in contact with a roller track curved inward so as to make possible the transfer of the heating plate from a stable open position of the press to a stable closed position as a result of a variable radius roller track of the press and vice-versa.

However, because the roller track is made rigidly solid with the frame, the heating plate is kept in a stable closed position of the press only within narrow limits of thickness of the fabric to be ironed.

To eliminate this drawback, the ironing press according to the invention is characterized in that its frame comprises flexible abutments against which a support for the roller track rests.

The accompanying drawing represents diagrammatically and by way of example an embodiment of the ironing press according to the invention.

FIG. 1 is a side view of it in elevation in the closed position.

FIG. 2 is a side view of it in elevation in the open position.

Figure 3:
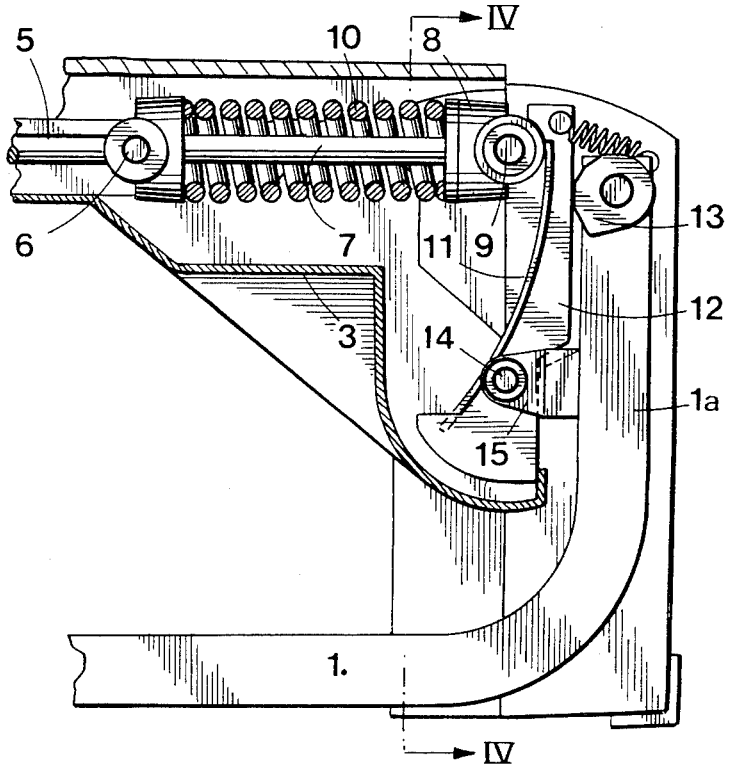
FIG. 3 is a partial view of FIG. 1 on a larger scale representing the control mechanism for opening and closing the press.

The ironing press represented in the drawing comprises a frame 1 that serves as a support for an ironing board 2 covered with fabric. An arm 3, on which a heating plate 4 is suspended, is connected to the frame 1 on pivot pins 14 engaged in lug holes 15 solid with the abutments 1*a* that it is provided with in its rear part. A manual control lever 5 is hinged on the arm 3 at a point 6 in front of these abutments 1*a*. The lever 5 has an extension 7 beyond its hinge point 6 that has a slide 8 equipped with two rollers 9. A spring 10 tends to keep the rollers in contact with two roller tracks 11 consisting of rolled piano wires applied against a support 12, cast in one piece, mounted to rotate on the pivot pins 14 solid with standards 1*a* of the frame 1. The roller tracks 11 have a constant radius whose center coincides with the hinged point 6 of the lever 5 and two cams 13 mounted on the abutments 1*a* of the frame 1, in contact with the support 12 provide their off-centering.

Figure 4:
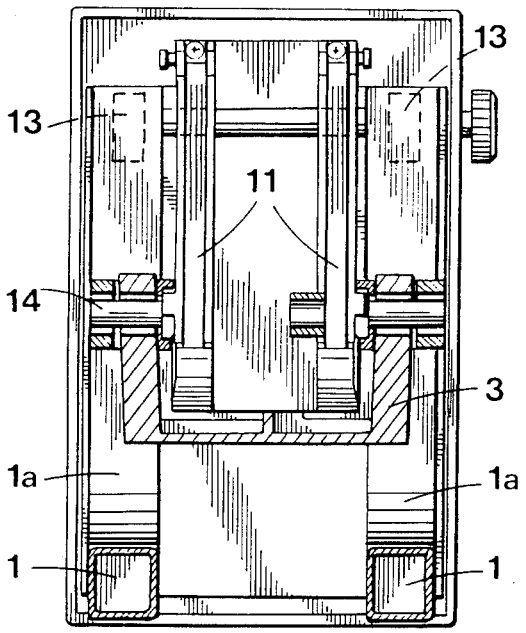
FIG. 4 is a view in cross section along IV—IV of FIG. 3.

Represented in FIGS. 1, 3 and 4 are the cams 13 in contact with the support 12 of the roller tracks 11 in their most off-centered position corresponding to a usual ironing fabric thickness. Under these conditions, the spring 10 is compressed during the closing and the opening of the press in stable positions, the hinge point 6 of the lever being moved upward in the open position of the press.

However, the stable position of the closed press can be maintained for a greater fabric thickness because the abutments 1*a* of the frame, which are made of steel are flexible and absorb the additional force exerted on them by the spring 10 of the lever 5.

Figure 5:
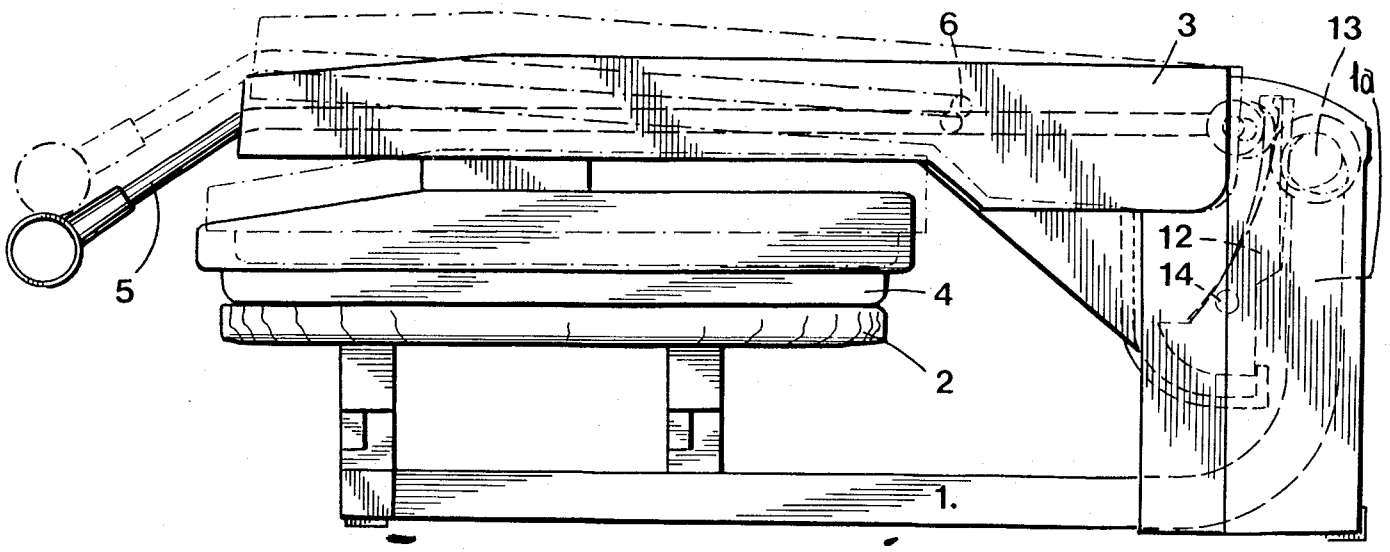
FIG. 5 is a view similar to FIG. 1 representing in dot and dash lines the effect of the off-centering of the roller tracks.

By reducing the radius of the cams 13 in contact with the support 12 of the roller tracks 11, a stable position for closing the press dring the ironing of fabrics of greater thickness can be found, as shown in dot and dash lines in FIG. 5.

The adjustment of the position of the cams 13 as a function of the thickness of the fabric to be ironed can be done manually or automatically. In the latter case, an electrical control mounted in the ironing board could assure the off-centering of the cams 13 as a function of the thickness of the fabric resting on the board 2.

In a simpler press, the cams 13 could be eliminated and the support 12 for the roller track could be attached to the abutments 1*a* of the frame 1 whose flexibility would now certainly make possible the ironing of fabrics with usual thickness without the help of a variable radius roller track.

We claim:

1. In an electric ironing press in which the opening and closing of the press is assured by a lever (5) hinged on the support arm (3) of a heating plate (4) at a point (6) distant from the hinge pin of the arm (3) on the support frame of an ironing board (2), said lever (5) extending beyond its hinge point (6) with the arm (3) and having at its free end rollers (9) held by a spring (10) in contact with at least one curved roller track (11), the improvement wherein said support frame (1) includes flexible abutments (1*a*), a support (12) for said roller track (11), said support resting against said abutment.

2. Press as in claim 1, wherein it comprises two roller tracks (11) whose support (12) rests against the abutments (1*a*) of the frame (1).

3. Press as in claim 2, wherein it comprises at least a cam (13) mounted on the standards (1*a*), making it possible to separate the support (12) from the abutments (1*a*) against the action of the spring (10).

4. Press as in claim 3, wherein the cam (13) assures the off-centering of the roller track (11).

5. Press as in claim 4, wherein the roller track (11) consists of at least a flexible section fastened on a support (12) cast as a single piece.

6. Press as in claim 5, wherein the flexible section fastened on a support as a single piece cast is a rolled piano wire.

7. Press as in claim 1, wherein the roller track (11) has a constant radius whose center coincides with the hinge point (6) of the lever (5).

* * * * *